US008085286B2

(12) United States Patent
McNestry et al.

(10) Patent No.: US 8,085,286 B2
(45) Date of Patent: Dec. 27, 2011

(54) PRINTING METHOD AND APPARATUS

(75) Inventors: Martin McNestry, Nottingham (GB); Philip Hart, Nottingham (GB)

(73) Assignee: Zipher Limited, Nottingham (GB)

( * ) Notice: Subject to any disclaimer, the term of this patent is extended or adjusted under 35 U.S.C. 154(b) by 1228 days.

(21) Appl. No.: 11/573,299

(22) PCT Filed: Aug. 1, 2005

(86) PCT No.: PCT/GB2005/003023

§ 371 (c)(1),
(2), (4) Date: May 23, 2007

(87) PCT Pub. No.: WO2006/013348

PCT Pub. Date: Feb. 9, 2006

(65) Prior Publication Data

US 2007/0252888 A1 Nov. 1, 2007

(30) Foreign Application Priority Data

Aug. 6, 2004 (GB) ..... 0417538.6

(51) Int. Cl.
*B41J 2/325* (2006.01)

(52) U.S. Cl. ..... 347/217; 347/215

(58) Field of Classification Search ..... 347/215, 347/217

See application file for complete search history.

(56) References Cited

U.S. PATENT DOCUMENTS 4,962,387 A 10/1990 Yamamoto et al.
5,182,573 A * 1/1993 Kim ..... 347/171
5,806,996 A 9/1998 Leys et al.
5,864,354 A * 1/1999 Hibino et al. ..... 347/212
5,903,299 A * 5/1999 Kawano ..... 347/217
5,971,634 A * 10/1999 Buckby et al. ..... 400/120.01
6,132,115 A * 10/2000 Insley et al. ..... 400/56

FOREIGN PATENT DOCUMENTS

| | | |
|---|---|---|
| EP | 0 431 621 | 6/1991 |
| GB | 2 289 652 | 11/1995 |
| GB | 2 315 244 | 1/1998 |
| GB | 2 335 163 | 9/1999 |

(Continued)

OTHER PUBLICATIONS

International Search Report mailed Dec. 20, 2005.

*Primary Examiner* — Manish S Shah
*Assistant Examiner* — Sarah Al Hashimi
(74) *Attorney, Agent, or Firm* — Beusse Wolter Sanks Mora & Maire, P.A.

(57) ABSTRACT

A method of printing an image onto a substrate including the steps of providing a substrate, a print head, and a carrier between the print head and the substrate; providing a backing roller; urging the print head towards the roller so as to urge the print head against the carrier, the carrier against the substrate, and the substrate against the roller; then selectively energizing print head heating elements while moving the print head in a first direction so as to move the print head along the substrate and transfer print medium from the carrier to the substrate to print a portion of the image on a respective area of the substrate; and after printing image portion, if there is at least one further image portion to be printed, moving the head, substrate, and carrier in a second direction, opposite to the first, in preparation for printing the next portion in a series of portions.

7 Claims, 2 Drawing Sheets

FOREIGN PATENT DOCUMENTS

| | | |
|---|---|---|
| GB | 2 383 974 | 7/2003 |
| GB | 2 400 582 | 10/2004 |
| JP | 53-015838 | 2/1978 |
| JP | 2000-079712 | 3/2000 |
| JP | 2001-080154 | 3/2001 |
| JP | 2002187301 | 7/2002 |

* cited by examiner

PRINTING METHOD AND APPARATUS

This application is the US national phase of international application PCT/GB2005/003023 filed 1 Aug. 2005 which designated the U.S. and claims benefit of Great Britain Application No. 0417538.6 filed 6 Aug. 2004, the entire contents of both are hereby incorporated by reference.

The present invention relates to thermal printers

Current thermal printers are generally produced in one of two different types: continuous; and intermittent. In continuous-type thermal printers, the print head is stationary and the substrate to be printed is moving during printing. The ribbon is driven, usually, but not always, at the same speed as the substrate and the print head is pressed against a print roller with the ribbon and substrate sandwiched in-between so as to transfer an image onto the substrate. In intermittent-type thermal printers, during printing the print head is moved against a flat print platen with the ribbon and substrate stationary in-between in order to transfer a print image.

In both cases there needs to be sufficient relative speed between the print head and the ribbon and substrate to achieve a satisfactory print. Consequently it has been necessary either to have an intermittent printing bracket which comprises a flat print platen, or a continuous printing bracket that comprises a print roller wherein the printhead is stationary whilst printing.

The trend is for applications to demand ever higher print speeds using continuous-mode printing onto a print roller. However, even in these applications occasionally it happens that a print needs to be done when the substrate speed is insufficiently high to achieve a good print. This problem results in some prints being missed, or needing to be reprinted if the substrate speed increases sufficiently to achieve a good continuous-mode print again.

Alternatively, it has been proposed that a machine could be built having both intermittent and continuous mode printing capability. However, this requires, for example, a special "rolling road" style of print platen, as set out in U.S. Pat. No. 5,971,634 for example, onto which either continuous or intermittent printing may be carried out. This involves significant additional expense and the added complexity means that wear of parts becomes a greater problem. Also, the technique cannot be applied to existing continuous-mode printers with a conventional roller-type print platen. Furthermore, the size of the image that can be printed using the apparatus disclosed in U.S. Pat. No. 5,971,634 is limited by the maximum length of travel of the print head over the print platen.

It is therefore an object of embodiments of the present invention to provide printing apparatus and methods of printing an image onto a substrate which obviate or mitigate at least one of the problems outlined above.

According to a first aspect of the present invention, there is provided a method of printing an image onto a substrate, the method comprising the steps of: providing a substrate; providing a print head having a plurality of heating elements; providing a carrier between the print head and the substrate, the carrier comprising a thermally sensitive print medium; providing a backing roller on the opposite side of the substrate to the carrier; urging the print head towards the roller so as to urge the print head against the carrier, the carrier against the substrate, and the substrate against the roller; while the print head is urging the substrate against the roller, selectively energizing the heating elements whilst moving the print head with respect to the roller from a first position on the roller's circumference to a second position on the roller's circumference so as to move the print head along the substrate and to transfer print medium from the carrier to the substrate to print at least a portion of the image on an area of the substrate.

Preferably the first position and the second position on the roller's circumference are separated by an angle of no more than 20 degrees, and even more preferably this separation angle is no more than 10 degrees. In certain embodiments the first position is on one side of a crown of the roller and the second position is on the opposite side of the crown.

The method may further comprise the step of holding the substrate stationary whilst moving the print head from the first position on the roller's circumference to the second position.

In certain embodiments, the method further comprises the step of feeding the substrate over the roller in a direction opposite to the direction of movement of the print head whilst moving the print head from the first position on the roller's circumference to the second position.

The carrier may be held stationary whilst moving the print head from the first position on the roller's circumference to the second position, or alternatively the method may comprise the step of feeding the carrier past the print head in a direction opposite to the direction of movement of the print head whilst moving the print head from the first position on the roller's circumference to the second position. In the latter case, the method may also comprise the step of moving the substrate and carrier together such that whilst the print head is moving from the first position on the roller's circumference to the second position there is no relative movement between the carrier and substrate under the print head.

After moving the print head from the first position on the roller's circumference to the second position to perform an incremental print, the method preferably also comprises the step feeding the substrate and carrier in a direction (e.g. the nominal feed direction) opposite to the direction of movement of the print head during the print, in preparation for printing a next image or a next portion of the same image. Similarly, after moving the print head over the roller to perform a print, the print head is then preferably moved in a direction (i.e. generally parallel to the substrate and carrier feed directions) opposite to the direction of movement of the print head during the print, in preparation for printing a next image or a next portion of the same image. Before moving the print head in the feed direction to position it for the next incremental print, the print head is preferably withdrawn (e.g. lifted) away from the roller after reaching the second position, such that during its return path it is not urging the carrier against the substrate.

In certain preferred embodiments the step of moving the print head from the first position on the roller's circumference to the second position comprises moving the print head at a speed such that the relative speed between the print head and carrier whilst printing is greater than a predetermined threshold.

Another aspect of the invention provides a method of printing an image on a substrate, the method comprising dividing the image into a series of portions, and printing each portion using a method as described above, such that the series of portions are printed on a series of respective areas of the substrate.

According to another aspect of the invention there is provided printing apparatus comprising: a roller adapted to support a flexible substrate; a substrate feed mechanism adapted to feed a flexible substrate in a feed direction over the roller; a print head comprising a plurality of heating elements; a carrier feed mechanism adapted to feed a flexible carrier, comprising a thermally sensitive print medium, between the print head and the substrate; a print head support assembly operable to move the print head towards the roller, such that the print head may, in use, urge the carrier against the substrate and the substrate against the roller, to withdraw the print head away from the roller, and to move the print head in the feed direction and in a direction opposite to the feed direction; and a controller adapted to control the print head and print head support assembly so as to urge the print head towards the roller to urge the print head against the carrier, the carrier against the substrate, and the substrate against the roller, and while the print head is urging the substrate against the roller, to selectively energize the heating elements whilst moving the print head with respect to the roller from a first position on the roller's circumference to a second position on the roller's circumference so as to move the print head along the substrate and to transfer print medium from the carrier to the substrate to print at least a portion of the image on an area of the substrate.

In certain preferred embodiments the print head support assembly comprises a pneumatic actuator operable to move the print head towards and away from the roller.

The apparatus preferably further comprises a detector arranged to monitor a feed speed of the substrate and provide a feed speed signal to the controller. If the substrate feed speed is above a predetermined threshold, the controller may be arranged to position the print head above a crown of the roller and then to urge the print head towards the roller and selectively energize the heating elements whilst holding the print head stationary and whilst the substrate is fed over the roller to provide continuous printing, and if the substrate speed falls below the predetermined threshold, the controller may be arranged to provide incremental printing by advancing the print head in the feed direction, urging the print head towards the roller, and moving the print head from the first position to the second position, and then withdrawing the print head away from the roller and advancing the print head again in preparation for printing a next image or image portion. Clearly, if the print head is being urged towards the roller and is in contact with the carrier when the substrate speed falls below the predetermined threshold, then the controller may be arranged to withdraw the print head away from the roller before advancing the print head in the feed direction. Similarly, the controller may be arranged to switch from incremental printing mode to continuous printing mode in response to substrate feed speed increasing during a print run.

Preferably, the carrier feed mechanism and print head support assembly are mounted on a printer baseplate.

According to another aspect of the invention there is provided a method of printing an image onto a substrate, the method comprising the steps of: providing a substrate; providing a print head having a plurality of heating elements; providing a carrier between the print head and the substrate, the carrier comprising a thermally sensitive print medium; urging the print head against the carrier so as to urge the carrier against the substrate; while the print head is urging the carrier against the substrate, selectively energizing the heating elements whilst moving the print head generally in a first direction (which may be referred to as the reverse direction) so as to move the print head along the substrate and to transfer print medium from the carrier to the substrate to print a first portion of the image on a first area of the substrate; then moving the print head, the substrate, and the carrier generally in a second direction (which may be referred to as the feed, or forward, direction), the second direction being opposite to the first; then urging the print head against the carrier so as to urge the carrier against the substrate; then while the print head is urging the carrier against the substrate, selectively energizing the heating elements whilst moving the print head in the first direction so as to move the print head along the substrate and to transfer print medium from the carrier to the substrate to print a second portion of the image on a second area of the substrate, the second area being adjacent to the first area.

After printing the second portion, the method may further comprise the steps of: moving the print head, the substrate, and the carrier in the second direction; then urging the print head against the carrier so as to urge the carrier against the substrate; and then while the print head is urging the carrier against the substrate, selectively energizing the heating elements whilst moving the print head in the first direction so as to move the print head along the substrate and to transfer print medium from the carrier to the substrate to print another portion of the image on another respective area of the substrate. These further steps may then be repeated as necessary to print further portions of the image onto a series of respective areas of the substrate until the complete image has been printed, or until continuous printing may be adopted, for example in response to an increase in substrate feed (i.e. supply) speed.

In certain embodiments the heating elements are arranged as an array extending at least partially across a width of the substrate, and each step of selectively energizing the heating elements whilst moving the print head in the first direction comprises moving the print head a distance substantially shorter than the length of the array, such that each portion of the image printed on the substrate is a transverse stripe.

Preferably, the method further comprises the step of providing a backing member on the opposite side of the substrate to the carrier, and each step of urging the print head against the carrier so as to urge the carrier against the substrate comprises urging the print head towards the backing member so as to urge the print head against the carrier, the carrier against the substrate, and the substrate against the backing member.

The backing member may be arranged to provide a substantially flat support surface to each area of the substrate whilst the respective image portion is being printed on that area.

Preferably, however, the backing member is a roller, and each step of selectively energizing the heating elements whilst moving the print head in the first direction comprises moving the print head with respect to the roller from a first position on the roller's circumference to a second position on the roller's circumference.

In certain preferred embodiments each step of selectively energizing the heating elements whilst moving the print head (i.e. in a direction generally opposite to the substrate feed direction) comprises moving the print head at a speed such that the relative speed between the print head and carrier whilst printing the respective image portion is greater than a predetermined threshold.

While an image portion is being printed the substrate may be being moved in the second (feed) direction. The substrate feed speed during printing may be lower, and even substantially lower, than the print head speed during printing.

Alternatively, the substrate may be held stationary whilst printing each image portion.

The method may also comprise the step of moving the carrier in the second direction whilst printing each image portion.

In certain preferred embodiments, the method further comprises the step of moving the carrier and the substrate in the second direction whilst printing each image portion, and the carrier and substrate may be moved together, at substantially the same speed.

In certain embodiments, the carrier may be held stationary whilst printing each image portion.

Preferably, the method further comprises the step of withdrawing the print head away from the carrier after printing each image portion, such that when the print head is moved in the second direction it is not in contact with the carrier.

Each step of moving the print head, the substrate, and the carrier in the second direction may comprises moving the substrate and carrier substantially the same distance and moving the print head a greater distance, or alternatively may comprise moving the print head, substrate, and carrier substantially the same distance.

The method may further comprise the steps of feeding the substrate past the print head in the second direction and monitoring the substrate feed speed, and when the feed speed is above a predetermined threshold printing on the substrate by holding the print head stationary, urging the print head against the carrier to urge the carrier against the substrate, and while the print head is urging the carrier against the substrate selectively energizing the heating elements so as to print (i.e. continuously) on the substrate as it is fed past the print head, and when the feed speed is below a predetermined threshold, printing on the substrate by printing image portions incrementally.

Another aspect of the invention provides a method of printing an image onto a substrate, the method comprising the steps of: providing a substrate; providing a print head having a plurality of heating elements; providing a carrier between the print head and the substrate, the carrier comprising a thermally sensitive print medium; dividing the image into a series of portions; printing each portion by urging the print head against the carrier so as to urge the carrier against the substrate and while the print head is urging the carrier against the substrate, selectively energizing the heating elements whilst moving the print head in a first direction so as to move the print head along the substrate and to transfer print medium from the carrier to the substrate to print the portion of the image on a respective area of the substrate; and after printing each portion, if there is at least one further portion of the image to be printed, moving the print head, the substrate, and the carrier in a second direction, the second direction being opposite to the first, in preparation for printing the next portion in the series, whereby the series of portions are printed on a respective series of areas of the substrate.

In preferred embodiments, each portion of the image is a stripe, and preferably a transverse stripe (i.e. a stripe which, when printed on the substrate, extends at least partially across the substrate, transverse to the feed direction).

The method may further comprise the step of withdrawing (e.g. lifting) the print head away from the carrier after printing each image portion, such that when the print head is moved in the second direction it is not in contact with the carrier.

Preferably, the method further comprises the steps of feeding the substrate past the print head in the second direction and monitoring the substrate feed speed, and while the feed speed is below a predetermined threshold, continuing to print on the substrate by printing image portions, and in response to the substrate feed speed increasing above a predetermined threshold, switching to a continuous print mode to complete the printing of a partially printed image or to print a subsequent image, wherein the continuous print mode comprises holding the print head stationary, urging the print head against the carrier to urge the carrier against the substrate, and while the print head is urging the carrier against the substrate selectively energizing the heating elements so as to print on the substrate as it is fed past the print head.

Embodiments of the invention will now be described, by way of example, with reference to the accompanying drawings, of which:

Figure 1:
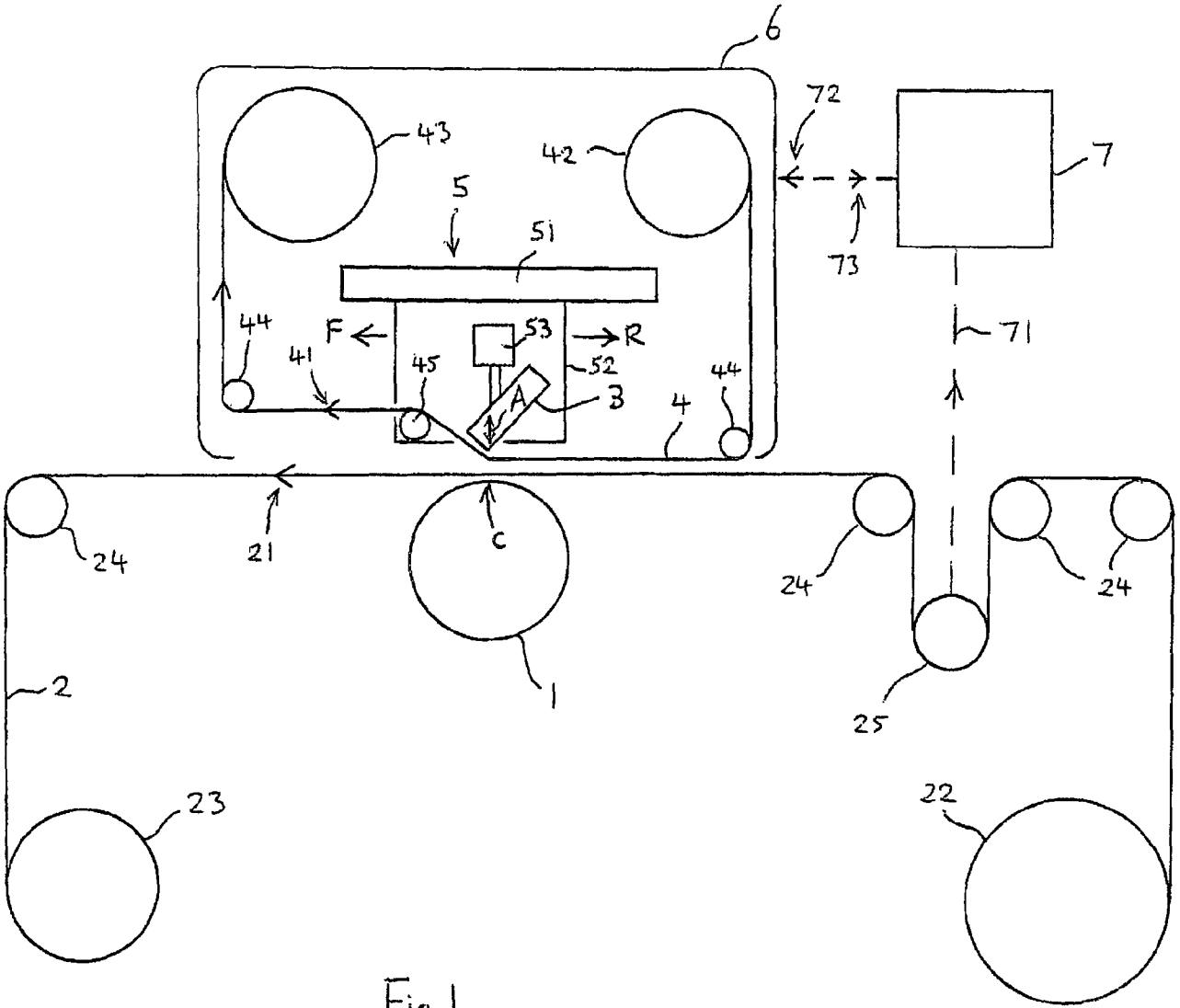
FIG. 1 is a schematic representation of printing apparatus embodying the invention.

Referring now to FIG. 1, a printing apparatus embodying the invention comprises a print roller 1 which, in use, is arranged to support a flexible substrate 2 which is fed over a crown C of the roller 1 in a feed direction 21 by means of a substrate feed mechanism. In this example the print roller 1 (which may also be referred to as a backing member or backing roller) is driven and has a resilient outer surface. However, in other embodiments the print roller may not be driven. The substrate feed mechanism comprises a supply spool 22 and a take-up spool 23. The flexible substrate is conveyed from the supply spool to the take-up spool by means of rollers 24, 25. Roller 25 is an encoder roller which provides a signal 71 to a controller 7, that signal being indicative of the instantaneous feed speed of the substrate 2. The printing apparatus also comprises a print head having a plurality of individually selectable heating elements. In this example these elements form a linear array which extends in a direction generally transverse to the flexible substrate 2 and parallel to the rotational axis of the print roller 1. These heating elements are located on the edge of the print head 3 that is closest to the print roller 1 in the figure. The individual heating elements are not shown in any of the figures; in practice there may be as many as 12 heating elements per millimeter along the print head edge, or even more. The print head 3 is supported by a print head support assembly 5. In this example, the support assembly 5 comprises a carriage 52 on which the print head is mounted, and a track 51 along which the carriage 52 can move. The apparatus also includes a controller 7 which is operable to supply control signals 72 to control movement of the print head and to selectively energize the heating elements. In particular, the controller 7 is operable to control the carriage 52 to move in the nominal forward and reverse directions, indicated respectively by arrows F and R. In this example, the forward direction F generally corresponds to the substrate feed direction over the print roller 1. Also mounted on the carriage 52 is an actuator 53 which is controllable by the controller 7 to move the print head in the directions indicated generally by arrow A, i.e. towards and away from the print roller 1.

The apparatus also comprises a carrier feed mechanism arranged to feed a flexible carrier 4 between the print head 3 and the substrate 21. The carrier comprises a thermally sensitive print medium (e.g. ink) and in this example is a carrier ribbon. The carrier feed mechanism comprises a supply spool 42 and a take-up spool 43. The carrier ribbon 4 is conveyed from the supply spool to the take-up spool 43 by means of rollers 44, 45. During a printing operation, the carrier is in contact with and passes over the edge of the print head 3 which carries the heating elements, and then passes over roller 45 which is mounted on the carriage 52. The roller 45 is referred to as a peel roller as it determines the angle at which the carrier is peeled from the substrate 21 after passing the lower edge of the print head 3.

In the example shown in FIG. 1, the carrier feed mechanism, the print head support assembly and the print head are mounted on a printer baseplate 6 which itself is held stationary with respect to the print roller 1 and the substrate feed mechanism. Thus, when the substrate is fed in the feed direction 21 this can be regarded as movement of the substrate in a first direction relative to the printer baseplate 6, and similarly the feeding of the carrier in the carrier feed direction 41 can also be regarded as movement of the flexible carrier in the first direction with respect to the printer baseplate 6.

The controller 7 of the apparatus of FIG. 1 is operable to cause the print head 3 to be urged towards the print roller 1, so as to urge the print head 3 against the carrier, the carrier against the substrate, and the substrate against the backing roller 1. The controller, in use, is arranged to receive image data and controls the printing of images on the flexible substrate 2. The controller is arranged to print in at least two modes, the particular print mode being determined by the signal 71 from the encoder roller 25. If the substrate feed speed is above a predetermined threshold then the controller prints in a first mode. In this first mode, the controller positions the print head 3 directly over the crown C of the print roller 1, urges the print head 3 towards the roller 1 so as to urge the carrier against the substrate and the substrate against the roller, and then selectively energizes the heating elements whilst the substrate 2 is continuously fed between the print roller 1 and print head 3. This first mode of printing can be regarded as normal continuous printing. However, if the sensed feed speed of the substrate is below a predetermined threshold, then the controller 7 controls the apparatus to print in a second mode. This mode will be referred to as incremental printing. In this incremental printing mode the controller 7 urges the print head 3 towards the print roller 1 as in the continuous mode, but then, rather than keeping the print head stationary, the print head is moved over the print roller surface in a direction generally opposite to the feed direction 21 of the substrate. This movement in the "reverse" direction is performed at a speed such that the relative speed between the print head 3 and the carrier ribbon 4 is above a predetermined threshold and the controller selectively energizes the heating elements whilst this relatively rapid reverse movement is being performed. If the image to be printed is only short (in terms of its extent along the substrate) then one movement in the reverse direction may be sufficient to print the entire image. More typically, however, the image to be printed may be long. In this case, the controller 7 builds up the image on the substrate by printing a series of transverse stripe portions of the image, each portion being printed by a respective reverse motion of the print head, with the print head being moved back to a forward, starting position after each stripe print. It will be appreciated that this incremental printing technique offers the advantage that high quality images may be printed even when the substrate feed speed is very low, or even if the substrate stops intermittently. This is possible because even when the substrate is stationary the print head 3 can be swept (i.e. moved) quickly for a short distance over the surface of the print roller 1 to achieve at least the predetermined minimum relative speed between the print head and carrier and so prints a high quality stripe portion of the image. When feed of the substrate is resumed the apparatus can continue to build up the image by incrementally printing stripes, or if the feed speed becomes high enough, the apparatus can revert to continuous printing mode. Thus, incremental printing may continue whilst the substrate feed speed is low, but in response to the feed speed increasing above a predetermined threshold the apparatus may switch to operating in continuous print mode, to complete a partially printed image and/or to print a subsequent image or images on the substrate. Similarly, continuous printing may continue while the feed speed is high, but in response to the feed speed falling below a predetermined threshold the apparatus may switch to incremental mode.

It will be appreciated that during a particular incremental print using the apparatus of FIG. 1, the substrate 2 may be moving relative to the print roller 1 and printer baseplate 6, or may be stationary. Similarly, the carrier ribbon 4 may be moving or stationary during a particular incremental print operation. In certain applications, however, it is desirable that the substrate and carrier are fed such that there is no relative movement between the two beneath the print head whilst the heating elements are being selectively energized. The apparatus of FIG. 1 is able to achieve this by monitoring the substrate feed speed and controlling the carrier feed mechanism.

It will be appreciated that after a particular incremental print the carrier and substrate should both be fed by an appropriate distance in the nominal forward direction such that the next incremental print can be made. After a particular incremental print, the print head 3 will, in general, be withdrawn away from the print roller and moved in the forward direction F, ready to be urged once more against the roller to commence the next incremental print.

Although FIG. 1 illustrates an example in which the substrate feed mechanism comprises both supply and take-up spools, it will be appreciated that in other embodiments different forms of feed mechanism may be used, and indeed may not comprise a take-up and/or a supply spool. For example, when the substrate is bag material, a supply spool may be used, but after printing the substrate may be passed to a bag-filling and sealing stage, rather than onto a take-up spool.

Figure 2:
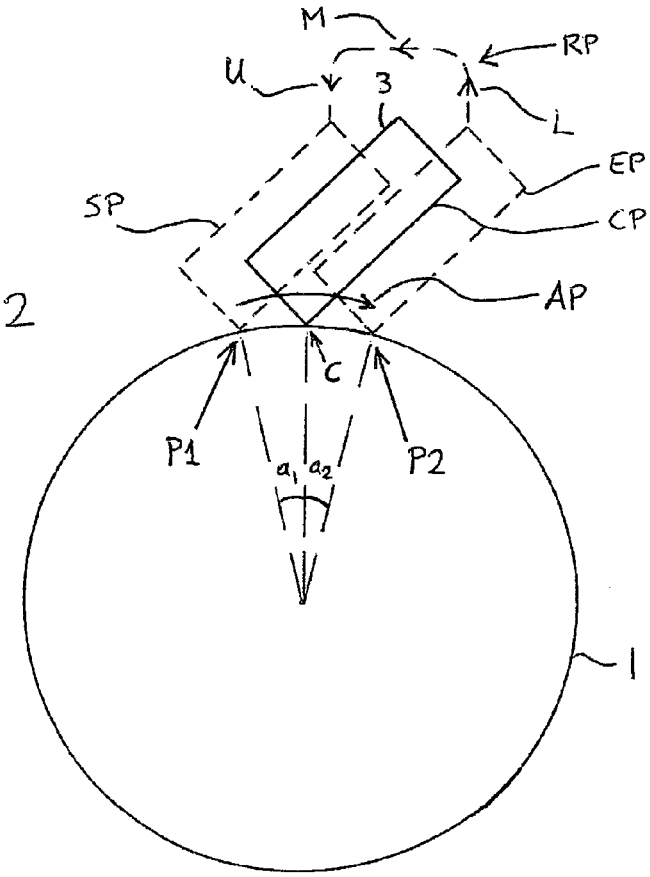
FIG. 2 is a schematic representation of the print head and print roller of an embodiment of the invention, illustrating the movement of the print head with respect to the roller.

Moving on to FIG. 2, this illustrates the movement of the print head 3 relative to the print roller 1 during the incremental print operation in more detail. Although not shown in the figure, in practice the carrier ribbon and substrate would be sandwiched between the print head 3 and print roller 1. During continuous printing the print head 3 is located in position CP, that is with the edge carrying the heating elements pressing down on the crown C of the roller. In contrast, during incremental printing the print head 3 is moved to a start position SP with its active edge pressing down at a position P1 on the roller surface. Then, whilst continuing to press down on the roller surface, the print head 3 is moved through an arcuate path AP ending at end position EP with the active edge pressing down at a second position P2 on the roller surface. Whilst this arcuate movement is being performed, the heating elements of the print head are being selectively energized to print an image portion on the substrate. After performing this print the print head is moved along a return path RP to bring it back to the start position SP from the end position EP. This return path in general comprises a lifting movement L away from the roller, a lateral movement M generally along the substrate feed direction, and a downwards movement U to bring the print head back into contact with the carrier and urge it towards the roller. In this example, position P1 is an angle a1 before the crown C of the roller and position P2 is an angle a2 after the crown C. In this example, a1 and a2 are equal but in other embodiments this may not be the case. Position CP is the optimum position for printing onto the roller, and it is therefore desirable to keep angles a1 and a2 small. In certain embodiments positions P1 and P2 are separated by a total angle of no more than 20°, and even more preferably this may be less than 10°.

Figure 3:
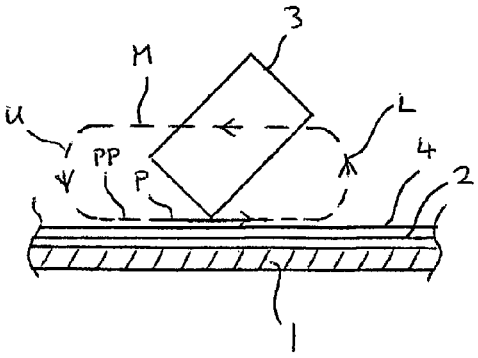
FIG. 3 is a schematic representation of a print head above a carrier, substrate, and support surface, illustrating movement of the print head in an incremental print method embodying the invention.

Referring now to FIG. 3, this illustrates an alternative printing method embodying the invention in which the substrate 2 is supported by a flat backing member 1 during an incremental print operation. Again the carrier is located between the print head 3 and the substrate and the path of the active edge of the print head during the incremental print is illustrated. This path includes an initial portion PP in which the active edge is urging the carrier against the substrate, and the substrate against the backing member but during which the heating elements are not being energized. This is a pre-printing stage in which the print head is being accelerated so as to bring its speed relative to the carrier up to a predetermined threshold. The portion P of the path which is shown as solid line represents the portion during which the active edge is urging the substrate against the backing member and the heating elements are being energized, i.e. it represents the extent of the actual print. After portion P there is a lift portion L where the print head is lifted from the carrier. Portion M illustrates the advancement of the print head 3 along the substrate feed direction, and portion U represents bringing the print head back into contact with the carrier to commence the next incremental print.

Figure 4:
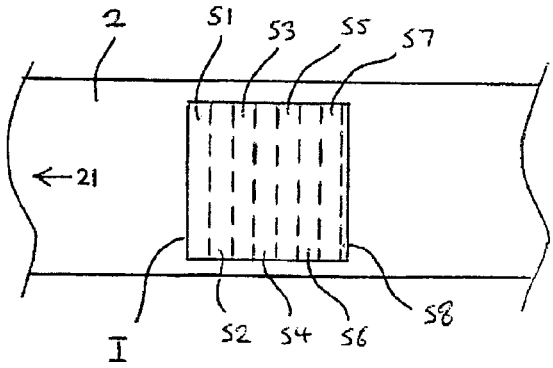
FIG. 4 is a schematic presentation of part of a flexible substrate upon which an image has been printed using a method embodying the invention.

FIG. 4 shows part of a flexible substrate upon which an image has been printed using an incremental printing method embodying the invention. The substrate feed direction 21 is shown and it can be seen that the large image I is formed from a series of transverse stripe portions S1-S8, each printed on a respective area of the substrate. These areas are adjacent to one another such that the image I is substantially continuous, i.e. there are no significant gaps between adjacent stripes. In certain embodiments, there may be no gaps between the stripes, and adjacent stripes may indeed overlap. For example, in certain embodiments the last part (e.g. 0.25 mm) of the last (i.e. the last-printed, preceding) stripe is reprinted at the start of the next stripe, this reprinted part being placed over the position at which it was printed in the last stripe. This can help produce a more legible overall image (or simply an overall image having a clearer, better appearance), especially if there are slight inaccuracies in print positioning. A single image may thus be built up (i.e. printed) from a series of printed portions, at least some of which may overlap. This technique may also be regarded as dividing the image up into a series of image portions, at least some of which overlap. Thus, when two portions overlap, they will of course have some of the complete image in common.

It will be appreciated from the preceding description and summary of the invention that one aspect of the invention provides a method of printing using a printhead with a plurality of print elements, each of which may be operated during printing to transfer a pixel of print medium (e.g. ink) from a carrier (e.g. ribbon) onto an adjacent substrate, the method including moving the print head whilst printing onto a print roller, wherein the print head moves with respect to the roller from a position a few degrees before to a few degrees after (or the opposite) the crown of the print roller.

In certain embodiments of the invention, a complete image is built up of several of these small incremental print operations around the crown of the roller, each time lifting the print head at the end of each print operation, advancing the ribbon whilst bringing the print head back to the start position a few degrees before/after the crown of the print roller, and repeating for as many times as is necessary to complete the image.

During each incremental print operation the ribbon may be held stationary since the print head is traversed around the print roller crown at a relatively high speed with respect to the low speed of the substrate and the print head is therefore in contact with the substrate and ribbon only for a relatively short time period, thus not impeding the substrate flow (i.e. motion) to any significant level.

It will also be appreciated that certain methods embodying the invention enable a standard (albeit of the type which has the ability to traverse the print head in a direction parallel to the substrate travel) 'continuous mode' printer within a standard 'print roller' style printer bracket without any physical modifications to print on a substrate that is travelling at low speeds or even when stationary.

An image printed using an embodiment of the present invention may, for example, comprise or consist of one or more of the following: a label; labelling information; a bar code; a figure; a representation of an artistic work (e.g. a graphic work or a photograph); a piece of intelligible text; a representation of a design; and a logo. It will be appreciated that this list is by no means exhaustive, and other forms of single image may readily be printed using embodiments of the invention.

It will also be appreciated that the image portions referred to throughout this specification may be individually intelligible (e.g. an image portion of a single image that is a label may comprise a legible line of information on one aspect of a product), may be individually unintelligible (e.g. an image portion may be just one stripe of a bar code, or one stripe of an artistic work), or may be individually partially intelligible (e.g. an image portion may comprise a legible complete line of text and only part of another line).

The invention claimed is:

1. A method of printing an image onto a substrate, the method comprising:

a) providing a substrate;

b) providing a print head having a plurality of heating elements;

c) providing a carrier between the print head and the substrate, the carrier comprising a thermally sensitive print medium;

d) urging the print head against the carrier so as to urge the carrier against the substrate;

e) while the print head is urging the carrier against the substrate, selectively energizing the heating elements while moving the print head in a first direction so as to move the print head along the substrate and to transfer print medium from the carrier to the substrate to print a first portion of the image on a first area of the substrate;

f) then moving the print head, the substrate, and the carrier in a second direction, the second direction being opposite to the first direction;

g) then urging the print head against the carrier so as to urge the carrier against the substrate;

h) then while the print head is urging the carrier against the substrate, selectively energizing the heating elements while moving the print head in the first direction so as to move the print head along the substrate and to transfer print medium from the carrier to the substrate to print a second portion of the image on a second area of the substrate, the second area being adjacent to the first area along a longitudinal axis of the substrate; and, wherein each step of selectively energizing the heating elements while moving the print head in the first direction comprises moving the print head with respect to the roller from a first position on the circumference of the roller to a second position on the circumference of the roller.

2. A method in accordance with claim 1, wherein the first position and the second position on the circumference are separated by an angle of no more than 20 degrees.

3. A method in accordance with claim 2, wherein the first position and the second position on the circumference are separated by an angle of no more than 10 degrees.

4. A method in accordance with claim 1, wherein the first position is on one side of a crown of the roller and the second position is on an opposite side of the crown.

5. A method of printing an image onto a substrate, the method comprising:

a) providing a substrate;

b) providing a print head having a plurality of heating elements;

c) providing a carrier between the print head and the substrate, the carrier comprising a thermally sensitive print medium;

d) urging the print head against the carrier so as to urge the carrier against the substrate;

e) while the print head is urging the carrier against the substrate, selectively energizing the heating elements while moving the print head in a first direction so as to move the print head along the substrate and to transfer print medium from the carrier to the substrate to print a first portion of the image on a first area of the substrate;

f) then moving the print head, the substrate, and the carrier in a second direction, the second direction being opposite to the first direction;

q) then urging the print head against the carrier so as to urge the carrier against the substrate;

h) then while the print head is urging the carrier against the substrate, selectively energizing the heating elements while moving the print head in the first direction so as to move the print head along the substrate and to transfer print medium from the carrier to the substrate to print a second portion of the image on a second area of the substrate, the second area being adjacent to the first area along a longitudinal axis of the substrate;

i) moving the substrate in the second direction while printing each image portion wherein the step of moving the substrate in the second direction while printing each image portion comprises moving the substrate at one speed and moving the print head at a higher speed.

6. A method of printing an image onto a substrate, the method comprising:

a) providing a substrate;

b) providing a print head having a plurality of heating elements;

c) providing a carrier between the print head and the substrate, the carrier comprising a thermally sensitive print medium;

d) urging the print head against the carrier so as to urge the carrier against the substrate;

e) while the print head is urging the carrier against the substrate, selectively energizing the heating elements while moving the print head in a first direction so as to move the print head along the substrate and to transfer print medium from the carrier to the substrate to print a first portion of the image on a first area of the substrate;

f) then moving the print head, the substrate, and the carrier in a second direction, the second direction being opposite to the first direction;

g) then urging the print head against the carrier so as to urge the carrier against the substrate;

h) then while the print head is urging the carrier against the substrate, selectively energizing the heating elements while moving the print head in the first direction so as to move the print head along the substrate and to transfer print medium from the carrier to the substrate to print a second portion of the image on a second area of the substrate, the second area being adjacent to the first area along a longitudinal axis of the substrate; and, wherein each step of moving the print head, the substrate, and the carrier in the second direction comprises moving the substrate and carrier substantially the same distance and moving the print head a greater distance.

7. A method of printing an image onto a substrate, the method comprising:

a) providing a substrate;

b) providing a print head having a plurality of heating elements;

c) providing a carrier between the print head and the substrate, the carrier comprising a thermally sensitive print medium;

d) urging the print head against the carrier so as to urge the carrier against the substrate;

e) while the print head is urging the carrier against the substrate, selectively energizing the heating elements while moving the print head in a first direction so as to move the print head along the substrate and to transfer print medium from the carrier to the substrate to print a first portion of the image on a first area of the substrate;

f) then moving the print head, the substrate, and the carrier in a second direction, the second direction being opposite to the first direction;

g) then urging the print head against the carrier so as to urge the carrier against the substrate;

h) then while the print head is urging the carrier against the substrate, selectively energizing the heating elements while moving the print head in the first direction so as to move the print head along the substrate and to transfer print medium from the carrier to the substrate to print a second portion of the image on a second area of the substrate, the second area being adjacent to the first area along a longitudinal axis of the substrate;

i) feeding the substrate past the print head in the second direction and monitoring a substrate feed speed; and, when the feed speed is above a predetermined threshold, printing on the substrate by holding the print head stationary, urging the print head against the carrier to urge the carrier against the substrate, and while the print head is urging the carrier against the substrate selectively energizing the heating elements so as to print on the substrate as it is fed past the print head; and, when the feed speed is below a predetermined threshold, printing on the substrate by printing image portions according to steps d) to h).

* * * * *